US005547718A

United States Patent [19]

Shapiro

[11] Patent Number: 5,547,718

[45] Date of Patent: Aug. 20, 1996

[54] MOTORIZED SPINNING ILLUSION DEVICE

[76] Inventor: Ted S. Shapiro, 55 W. Eleventh St., Apt. 6C, New York, N.Y. 10011

[21] Appl. No.: 144,043

[22] Filed: Nov. 1, 1993

[51] Int. Cl.[6] ..... B44C 3/00; G09F 19/12

[52] U.S. Cl. ..... 428/13; 40/414; 40/430

[58] Field of Search ..... 428/11, 13, 7; 446/243; 40/414, 430, 473

[56] References Cited

U.S. PATENT DOCUMENTS

| | | | |
|---|---|---|---|
| 1,631,272 | 6/1927 | Kielar | 446/243 |
| 2,840,689 | 6/1958 | Kazor | 428/11 X |
| 4,070,819 | 1/1978 | Kelly | 40/473 X |
| 4,207,696 | 6/1980 | Hyman et al. | 40/473 |
| 5,146,702 | 9/1992 | Belokin, Jr. | 40/430 |

FOREIGN PATENT DOCUMENTS

| | | | |
|---|---|---|---|
| 2636222 | 3/1990 | France | 40/430 |

*Primary Examiner*—Henry F. Epstein

*Attorney, Agent, or Firm*—Ruffin B. Cordell; Michael J. McKeon

[57] ABSTRACT

A novelty illusion device producing an illusion of a shimmering floating bubble having a transparent case, an illusion object disposed within the case, an electric motor for producing rotational force, a power circuit and power source for driving the motor, and a drive shaft for transferring rotational force from the motor to the illusion object. The drive shaft is rendered virtually invisible to an observer when the drive shaft is rotating by concealing the shaft within a groove formed in the casing. The illusion object is made of a plurality of mylar strips joined at both ends to form a cage structure. Additional circuits are included to vary the movement of the illusion periodically and in response to detected sounds.

18 Claims, 8 Drawing Sheets

MOTORIZED SPINNING ILLUSION DEVICE

BACKGROUND OF THE INVENTION

The invention relates to an illusion device for amusement and entertainment purposes. The invention is more specifically suited to an illusion device which seems to the observer to produce a shimmering bubble floating in free space with no visible means of support or motivation. Specifically, this invention relates to a device which is capable of invisibly animating an object within a sealed, transparent environment. More specifically, this invention relates to a novel sculptural cage design of commercially available silver diffraction grating MYLAR brand polyester film and a novel arrangement for electrically rotating it within a sealed transparent case for the purpose of creating the illusion of a floating transparent bubble which changes in shape and scintillates with color.

FIELD OF THE INVENTION

Novelty devices which produce unique illusions have been long used to entertain and amuse observers. Typically, many such illusions have accompanied technical advances which make the illusion possible. For example, an embodiment of one such novelty device utilizes a base unit having a support arm which holds a number of concentric rings. The outermost ring is attached to the arm and to the other progressively smaller rings in such a way that they can all rotate freely inside one another, yet no two have the same axis. A visible magnet on the outermost ring is motivated by a timed electromagnet in the base unit, thereby causing this ring to rotate back and forth on its axis and to motivate the other rings inside it to rotate slowly on their respective axes. While the device suggests an illusion of perpetual motion, the obvious visibility of the attached magnet moving back and forth over the base unit reveals that the base is responsible for the motion of the device and, consequently, the notion of "impossibility" is diminished. Also, because the rotational movement of the rings is both slow and limited in its vocabulary, the device fails to achieve a visual transformation that might make it appear to be something other then the plastic materials of which it is obviously constructed.

Another novelty illusion device utilizes a base unit from which two visible straight rods protrude upward in a "V" pattern similar to the "rabbit ears" antennae used for televisions. Mounted visibly at the top of each rod is a motor, positioned in such a way that its shaft faces inward toward the shaft of the motor on the opposing rod. Strung between the shafts of these motors is a slack piece of string which spins in a variety of patterns when power is supplied. The tension of the string can be altered manually by adjusting the rods so that the distance between the visible motors increases or decreases. A flickering, colored light shining up from inside the base unit illuminates the string. While in this device the string indeed undergoes a transformation and is visually stimulating, the visibility and noise of the two motors atop the rods as well as the presence of motor speed and light control adjustment dials on the base unit make obvious the mechanics behind the illusion, thereby diminishing the potential mystery of its operation. This device encounters another limitation in that when power is stopped to the motors the string hangs in a single, slack position. Moreover, the device employs a power cord which needs to be plugged into a wall outlet. This limits the possible locations of its use and is another factor to diminish the potential mystery of its operation.

Another novelty illusion device utilizes a short rod of twisted wire that is held at the bottom in one hand of the user. The user's other hand quickly slides a small bead up the rod which, due to the "threaded" twines of the wire, causes two crisscrossed rings of MYLAR brand polyester film strips mounted just above the bead to spin up the rod and form a primitive illusion. The strips are thick in width and cut in perfectly straight, parallel lines. The illusion is primitive and the potential effect of a soap film bubble is not possible. Moreover, because the device is powered manually, there is no apparent mystery as to its operation.

Another novelty illusion suspends a small ball in air in the middle area of a base unit resembling an upright, squared-off letter "O." The suspension is accomplished by a stepped electromagnet in the top of the unit controlled by a series of infra-red sensors in the sides. While the illusion of the suspension is complete, the device is limited in its satisfaction beyond this potential mystery because it is not also visually stimulating. When the ball is not moved by the user it remains completely static. Though the user can manually spin the ball, which has a multifaceted surface and reflects lights mounted within the unit, this rotation lasts only a few moments and is difficult to accomplish because the ball, when touched, falls easily from the magnetic field. Moreover, while manipulating the ball, the user is able to feel this magnetic field and thus begins to decipher the mystery of the illusion.

Although previously known novelty illusions have received considerable use, it would be highly desirable to provide a device which would feature a mysteriously suspended and visually stimulating object that is everchanging without requiring manipulation from the user, which would have both the source of its motive force and the energy that powers that force completely hidden from view and which would have the appearance (illusion) of being comprised of a material other then that of which it is actually constructed. The foregoing should be advantageously achieved with a unit which would not betray elements of its means of operation to even the principal user as well as the invited observer, which would be aesthetically pleasing even when not in operation and which would be inexpensive to manufacture.

The difficulties and limitations suggested in the preceding are not intended to be exhaustive but rather among the many which may tend to reduce the effectiveness and user satisfaction with prior illusion devices and the like. Other noteworthy problems may also exist. However, those presented above should be sufficient to demonstrate that prior illusion devices appearing in the past will admit to worthwhile improvement.

SUMMARY OF THE INVENTION

In contrast to prior art illusion devices, the present invention is particularly, although not exclusively, directed to an illusion device which seems to the observer to produce a shimmering bubble floating in free space.

In the preferred embodiment, the present invention consists of a unique MYLAR brand polyester film cage structure that when rotated appears to be a solid surface semi-transparent bubble which moves and undulates in the manner of a large soap film bubble. The MYLAR brand polyester film cage is suspended within a clear plastic case to enable viewing but which will prevent the observer from touching or otherwise examining the illusion closely. Hidden in the bases of the device are a motor and battery supply module which produce rotational output to rapidly spin the MYLAR brand polyester film cage. A unique drive shaft link is provided in the form of a single strand of specialized wire which will transmit continuous rotational energy over relatively long distances and will transmit that continuous rotational energy through sharp curves. The drive shaft wire is effectively concealed along the corners of the plastic box or case to complete the illusion that the bubble is floating in free space without any means of support or motivation.

A primary advantage of the present invention is its ability to produce an illusion of a moving bubble without any apparent means of support or motivation.

A further advantage of the present invention is its unique single strand drive shaft features which transmit continuous rotational energy over relatively long distances and through sharp curves.

A still further advantage of the present invention is its ability to conceal motor, circuit, battery and light modules within the structures of the device and its ability to dampen all sound produced by this motor.

A still further advantage of the present invention is the visual effect produced by the unique MYLAR brand polyester film cage utilized.

A still further advantage of the present invention is that drive shaft structures may be effectively concealed in the supporting case of the device.

A further advantage of the present invention is the dynamic nature of the movement of the illusion.

A still further advantage of the present invention is the selective variation in the pattern of movement of the illusion.

A still further advantage of the present invention is the capability of the device to alter its movement patterns in response to user inputs such as sound or touch.

OBJECTS OF THE INVENTION

It is therefore a general object of the invention to provide a novel illusion device or the like which will obviate or minimize the problems previously described with reference to the prior art.

It is a specific object of the invention to provide a novel illusion device which will produce the appearance of a moving, shimmering semi-transparent bubble with no visible means of support or motivation.

It is another object of the invention to provide a novel illusion device which incorporates unique drive shaft features.

It is another object of the invention to provide a novel method of virtually invisibly animating an object which is displayed within a sealed, transparent environment.

It is a specific object of the invention to spin a cage of silver diffraction grating MYLAR brand polyester film by connecting it to a battery powered motor.

It is a specific object of the invention to spin a cage of silver diffraction grating MYLAR brand polyester film by connecting it to a battery powered motor so that it assumes the appearance of a soap film bubble.

It is another object of the invention to control the battery powered motor through an electronic circuit so that the rotational speed of the motor fluctuates in a series of patterns and thereby causes the spinning cage to distort through a variety of shapes for different durations of time.

It is another object of the invention to provide a spherical silver diffraction grating MYLAR brand polyester film cage with its vertical strips formed in such a way that when it is rotated by a motor the strips will flutter in the turbulence of the air to continuously alter the overall shape of the cage.

It is a specific object of the invention to provide a small weight mounted in the bottom of the cage to augment and quicken the effect that rotational speed changes have on the size and shape of the cage.

It is still another object of the invention to provide a novel unshielded monofilament flexible direct drive link between a motor and remote object to be rotated by that motor in such a way that the link is virtually invisible to the eye.

It is still another object of the invention to provide a path for an unshielded monofilament flexible direct drive shaft in such a way that both supports it structurally as it is rotating and yet also obscures it from view.

It is still another object of the invention to provide a transparent case housing which accommodates a monofilament drive shaft into the absolute inside corner of the case and along grooves in the edges of the case and therefore virtually obscures it from view.

It is still another object of the invention to provide an adjustable coupler which allows precise adjustment of the tension of the monofilament drive shaft.

It is an object of the invention to provide a means of concealing from view the presence of the motor which powers the invention, the batteries that power this motor and the circuit and switches that control this motor.

It is a specific object of the invention to provide the power and the motive force of an electric motor to an object at a remote distance from the motor while keeping the power link between the motor and the object being powered virtually invisible from view across a fully visible distance between the motor and the object.

It is a specific object of the invention to provide a means of bending a portion of the single strand drive shaft so that as it rotates it will blur and become virtually invisible.

It is another object of the invention to provide a novel means of suspending an object within the center of the spinning cage without any visible means of support.

It is another object of the invention to provide a self-contained means of illuminating the spinning cage.

It is still another object of the invention to provide an illusion novelty that can be operated by battery power.

It is still another object of the invention to provide a means for varying the movement of the illusion in response to user inputs such as sound.

It is still another object of the invention to provide an illusion device which facilitates the appearance of a floating bubble by preventing tactile access to the bubble structure but nevertheless permits substantial observation of the device.

Other advantages and meritorious features of the present invention will be understood from the following description of the preferred embodiments, the appended claims, and the drawings, the brief description of which follows.

DETAILED DESCRIPTION OF THE INVENTION

Figure 1:
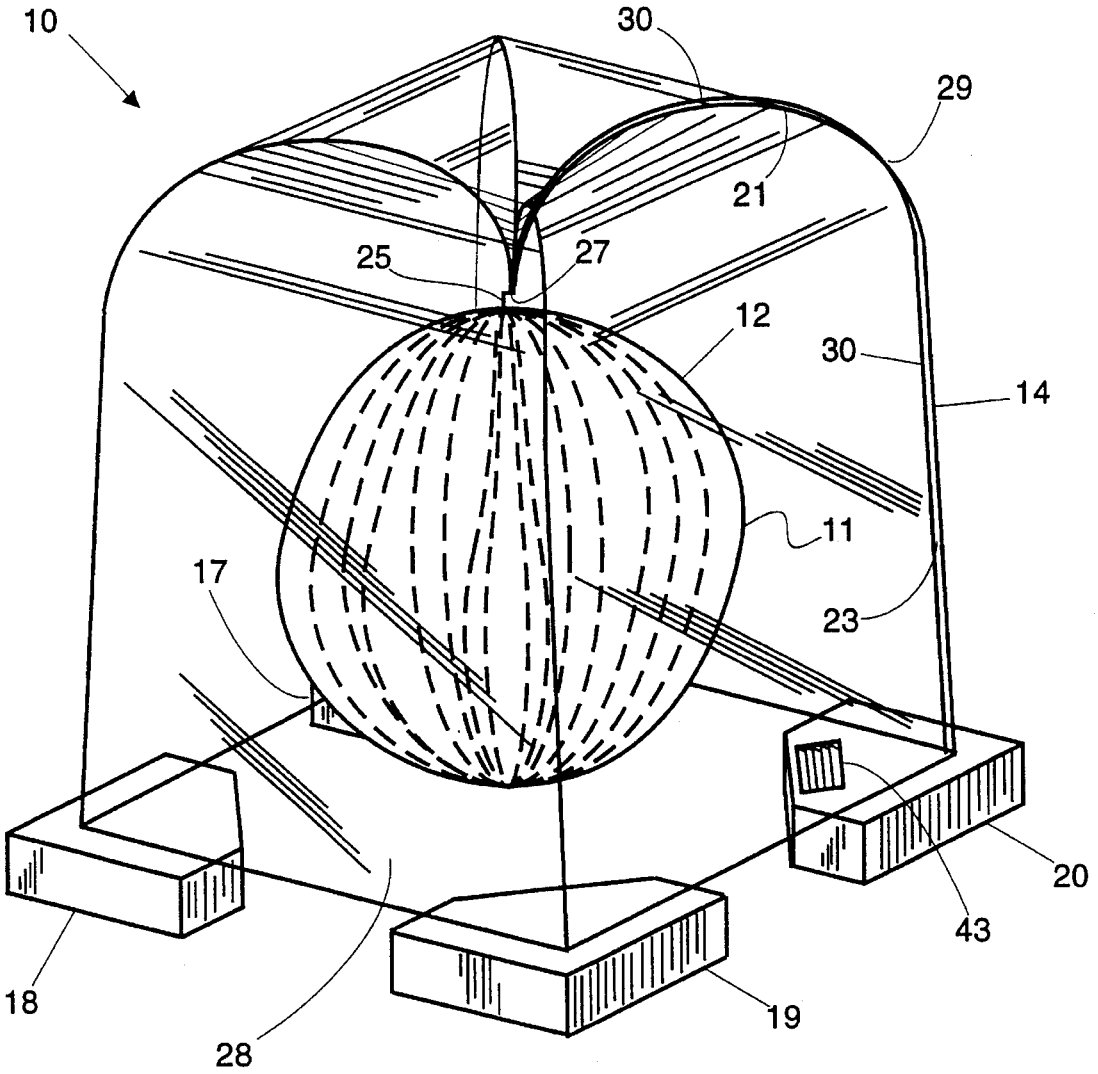
FIG. 1 is a perspective view of the illusion device of the present invention showing the major components of the device.
Figure 2:
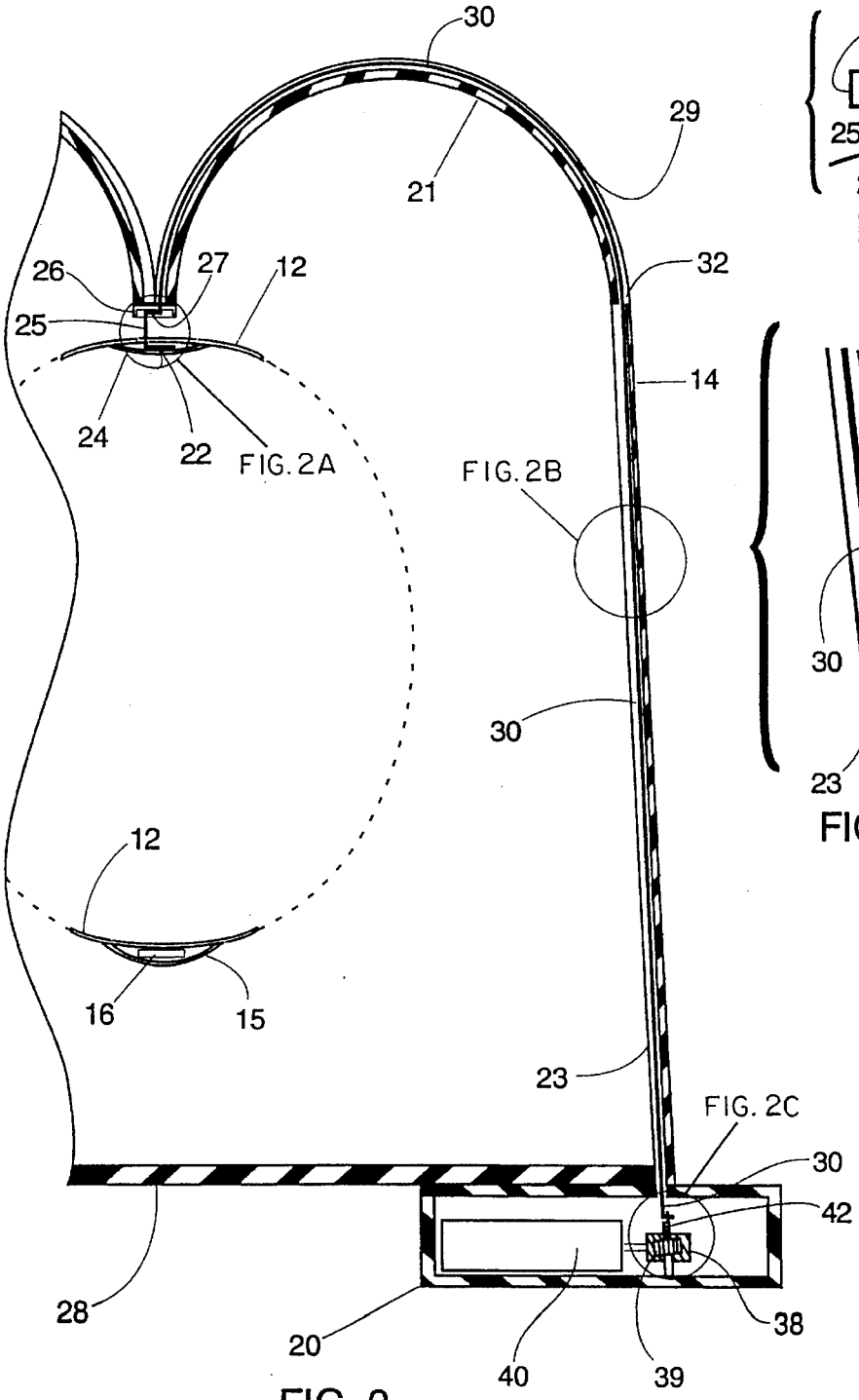
FIG. 2 is a cutaway view of the illusion device of the present invention showing the details of the arrangement of the drive shaft as it relates to the plastic case, the MYLAR brand polyester film cage and motor elements.

Referring to FIGS. 1 and 2, the illusion device 10 of the present invention is shown to include a MYLAR brand polyester film cage 12 enclosed within plastic case 14. Case 14 is a crystal clear, one piece housing comprised of four lateral side walls which slope slightly inward. The upper portion of each side wall arches in the manner of a barrel vault through 180 degrees and tapers down to a point where it meets the points of the other side walls in the center of the "ceiling" of case 14. Floor 28 is comprised of the same material as case 14 and is received by the lower edges of case 14 where it intimately contacts the inside wall surfaces of case 14 and is joined so that its lower surface is flush with the lower edges of each of the side walls of case 14. Case 14 and floor 28 may be advantageously injection molded from one of a group of plastic materials including acrylics and styrenes. In a preferred embodiment, however, the recommended material is acrylic.

Case 14 is supported by four opaque bases 17, 18, 19, and 20 as shown in the drawings. Each base is a one piece housing shell with a removable base plate (not shown) attached to the bottom of each base to conceal its internal elements. Each base and base plate may be advantageously injection molded from one of a group of plastic materials including acrylics and styrene. MYLAR brand polyester film cage 12 is suspended from drive shaft 30 at segment 22 and derives rotational force from drive shaft 30. Within base 20, there is a concealed motor 40 that is controlled by circuit 52 and switch 44 concealed in base 19. Motor 40 generates rotational force which is transmitted to drive shaft 30 through sprocket wheel 39 and coupler 42, also concealed in base 20. For reasons of clarity, drive shaft 30 is shown in FIG. 1 to be separated from interior corner 23 and groove 29. In the actual embodiment of the present invention, drive shaft 30 is effectively concealed within corner 23 and groove 29.

The illusion of the present invention is created when motor 40 is activated through switch 44. Motor 40 then generates rotational force at a selectively variable speed between 1200–1700 revolutions per minute. This speed is converted by the combination of worm gear 38 on the shaft of motor 40 and sprocket wheel 39 to a variable speed of between 180–250 revolutions per minute. This combination of worm gear 38 and sprocket wheel 39 also serves to increase the output torque presented to drive shaft 30 as well as to change the angle of the rotational force to be vertically in line with drive shaft 30. This rotational force is transmitted through drive shaft 30 to cage 12 which causes cage 12 to begin to rotate at the same speed. At this speed, the individual strands 13 of cage 12 are no longer visible due to hysteresis effects in human vision and instead the cage appears to be a continuous spherical surface 11 much in the same way a motion picture or video display appears to be a continuous image. The viewer perceives only the continuous surface of the "bubble" 11 and cannot discern the individual strands 13 of the mylar cage. The edges of strands 13 flutter in the turbulence of the air as the cage spins, producing a movement effect.

Figure 2A:
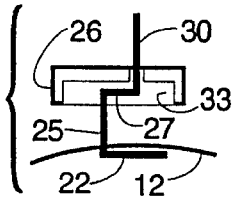
FIG. 2A is a close up view showing details of the distal end of the drive shaft of the present invention and the cap that registers and conceals the shaft.

Referring now specifically to FIG. 2, drive shaft 30 is concealed as detailed below, with only a short segment 25 between the top of case 14 and the top of cage 12 exposed in plain view. To render this segment 25 of drive shaft 30 barely visible, the drive shaft is bent sharply to a 90 degree angle where it enters the interior of the top of case 14 through a hole in cap 26 to form a short horizontal segment 27, note FIG. 2A. Rotation is not transferred around this 90 degree bend. Rather, horizontal segment 27 sweeps through each revolution of drive shaft 30. Cap 26 serves to register drive shaft 30 so that it exits groove 29 and enters case 14 exactly perpendicular to floor 28. A round depression 33 on the underside of cap 26 helps to conceal the revolution of horizontal segment 27. Cap 26 is advantageously molded from the same clear material as case 14.

After short horizontal segment 27 the drive shaft is bent downward sharply at a 90 degree angle to form a vertical segment 25. After vertical segment 25, drive shaft 30 is then bent again at a 90 degree angle so that the terminating length 22 of the drive shaft 30 is parallel to floor 28 of the case 14 and coplanar with segments 27 and 25. It is the final horizontal length 22 of drive shaft 30 upon which mylar cage 12 rests and is attached with joining MYLAR brand polyester film disk 24 from below.

When drive shaft 30 is rotated by motor 40, because segment 25 is offset from the center of rotation, segment 25 travels around in a circle of measurable arc at 180–250 revolutions per minute. Because of this rapid movement of segment 25 of drive shaft 30, combined with its extremely small diameter and the difficulties attendant to viewing such small objects through the plastic case, drive shaft 30 is nearly invisible to even the most persistent viewers. Thus bubble 11 appears to float and oscillate freely within case 14.

Figure 2B:
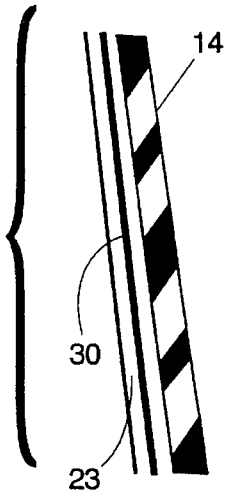
FIG. 2B is a close up view of a section of the corner of the plastic case of the present invention showing details of the concealing groove and drive shaft.
Figure 2C:
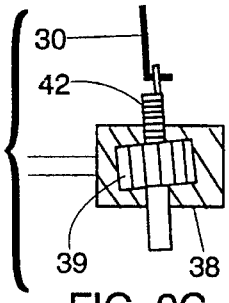
FIG. 2C is a close up view showing details of the gear and drive shaft junction of the present invention.

The object of the placement of drive shaft 30 is to conceal it as completely as possible from view by the observer. Referring now specifically to FIG. 2C, drive shaft 30 begins inside base 20 at coupling element 42 and terminates at its junction with cage 12 at segment 22. Drive shaft 30 is connected to motor 40 through coupling element 42 and sprocket wheel 39. Coupling element 42 is threaded and received into the top of sprocket wheel 39, thus providing the ability to finely adjust the tension on drive shaft 30. In order to ensure vibration free operation, it is important that coupling element 42 center drive shaft 30 exactly over the center of sprocket wheel 39 and that the rotational axis of sprocket wheel 39 be tilted to the same three degree angle as the side walls of case 14. Motor 40, sprocket wheel 39 and coupling element 42 are concealed within base 20.

Drive shaft 30 then is routed through the top of base cube 20 and up through floor 28 of case 14, precisely against the interior corner 23 of case 14. Drive shaft 30 then travels virtually invisibly up from the bottom of the case along this immediate inside corner 23. Referring specifically to FIG. 2B, drive shaft 30 is recessed slightly within a small groove formed in corner 23 to reduce its visibility to an observer. Upon reaching the arched upper surface 21 of case 14, drive shaft 30 exits the case directly into the small exterior groove 29 which runs along the ridge formed by the junction of two side walls of case 14. The tiny hole 32 through which drive shaft 30 passes from inside to outside case 14 is formed by the slight overlap of exterior groove 29 with that of the interior groove in corner 23. Drive shaft 30 then follows in groove 29 through arch 21 as it curves up and then down toward the center point of the top of case 14. Thus this arched segment 21 of the upper surface of case 14 provides structural support for the drive shaft as it makes its total 180 degree bend in groove 29. For cosmetic balance and for misdirection of the observer's eye, identical grooves are additionally provided along the top of the other three ridges on the upper surface of case 14. At the center point of the top surface of case 14 the distal end of drive shaft 30 exits the groove 29 and reenters the interior of the case through cap 26 where shaft 30 is now perpendicular to floor 28 at the point of entry.

The previously described 90 degree bend in drive shaft 30 at section 27 keeps a uniform tension between the point where drive shaft 30 re-enters the case and the point where it begins at coupler 42. This prevents any slack from developing in drive shaft 30 thus keeping it from riding out of exterior groove 29 or pulling away from interior corner 23 of case 14. The distal end of drive shaft 30 is fixed to joining disk 24.

Despite the 180 degree total bend in drive shaft 30, it must be capable of transmitting rotational force at speeds of over 200 revolutions per minute for an extended service life without developing metal fatigue or stress fractures or other failures. While other materials may suffice for this purpose, drive shaft 30 advantageously consists of a unique monofilament flexible shaft made of a length of 0.008" diameter straightened high carbon steel music wire which has undergone a cold tempering process of drawing from soft to hard. This material provides the high tensile strength and flexibility necessary to transmit high speed rotational energy around relatively sharp curves as required in the present invention without experiencing metal fatigue or stress fractures.

Figure 3:
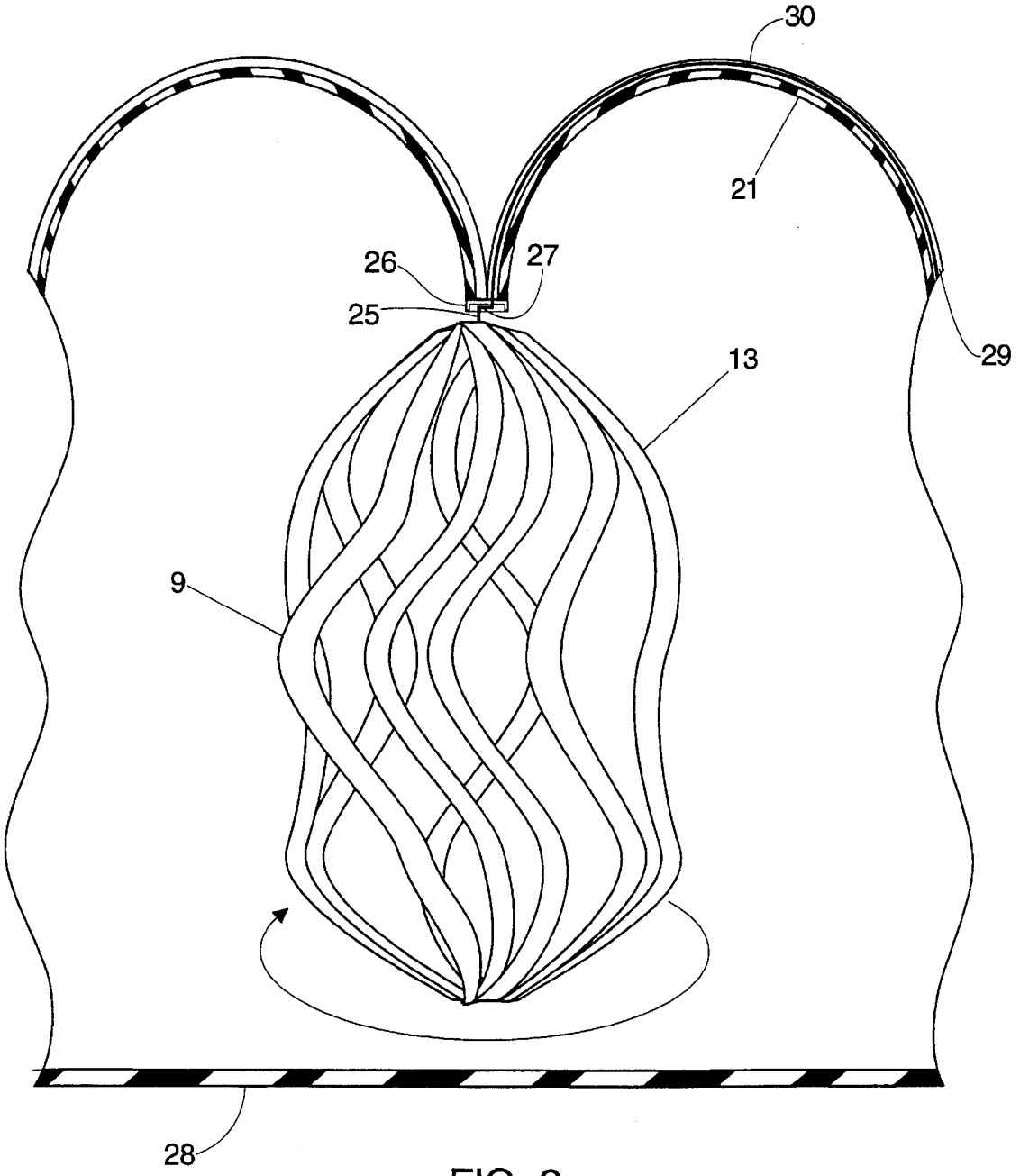
FIG. 3 is a close-up cutaway view of the MYLAR brand polyester film cage of the present invention.

In FIG. 3, cage 12 is shown in greater detail. The material used to fabricate cage 12 is commercially available silver diffraction grating MYLAR brand polyester film. A single sheet is die cut into eight strands 13, each end of which is mitered to a point. One end of each strand 13 is then gathered to form the top of cage 12 and the other end of each strand is gathered to form the bottom of cage 12. Noting again FIG. 2, at the top gathering point of cage 12 there is disposed a MYLAR brand polyester film joining disk 24 which is used to anchor the loose strands of 13 and to join cage 12 to drive shaft 30 at segment 22. The MYLAR brand polyester film disk 24 is made of the same material as cage 12. Underneath the bottom of cage 12 there is disposed a similar MYLAR brand polyester film joining disk 15 which is used to anchor the loose strands 13 and to conceal a small weight 16.

Each strand 13 is cut in a wave pattern as detailed in FIG. 3. The wave design, combined with the specific direction of rotation of the motor, enhances the turbulence experienced by strands 13 causing the bubble 11 to constantly undulate and change its shape. Although other patterns may be used, an advantageous wave pattern consists of three curves in each identical strand 13, with the second curve 9, located halfway between the top and bottom of cage 12, being the longest and least sharp. Because this long middle curve 9 gets little direct support from the top and bottom of the cage and virtually pivots on the points where it meets the curves above and below, and because it is in essence the leading edge of each strand when the cage 12 is spinning with a clockwise rotation, curve 9 acts like a sail, catching air and fluttering. A small weight 16 attached to the underside of the cage enables it to spin at a rapid rate and yet not expand so wide from centripetal force that cage 12 comes into contact with the sides of the case. More importantly, the weight 16 serves to change the shape of the cage more rapidly when rotational speeds from the motor 40 fluctuate as dictated by the circuit 52 in FIG. 6.

Figure 4:
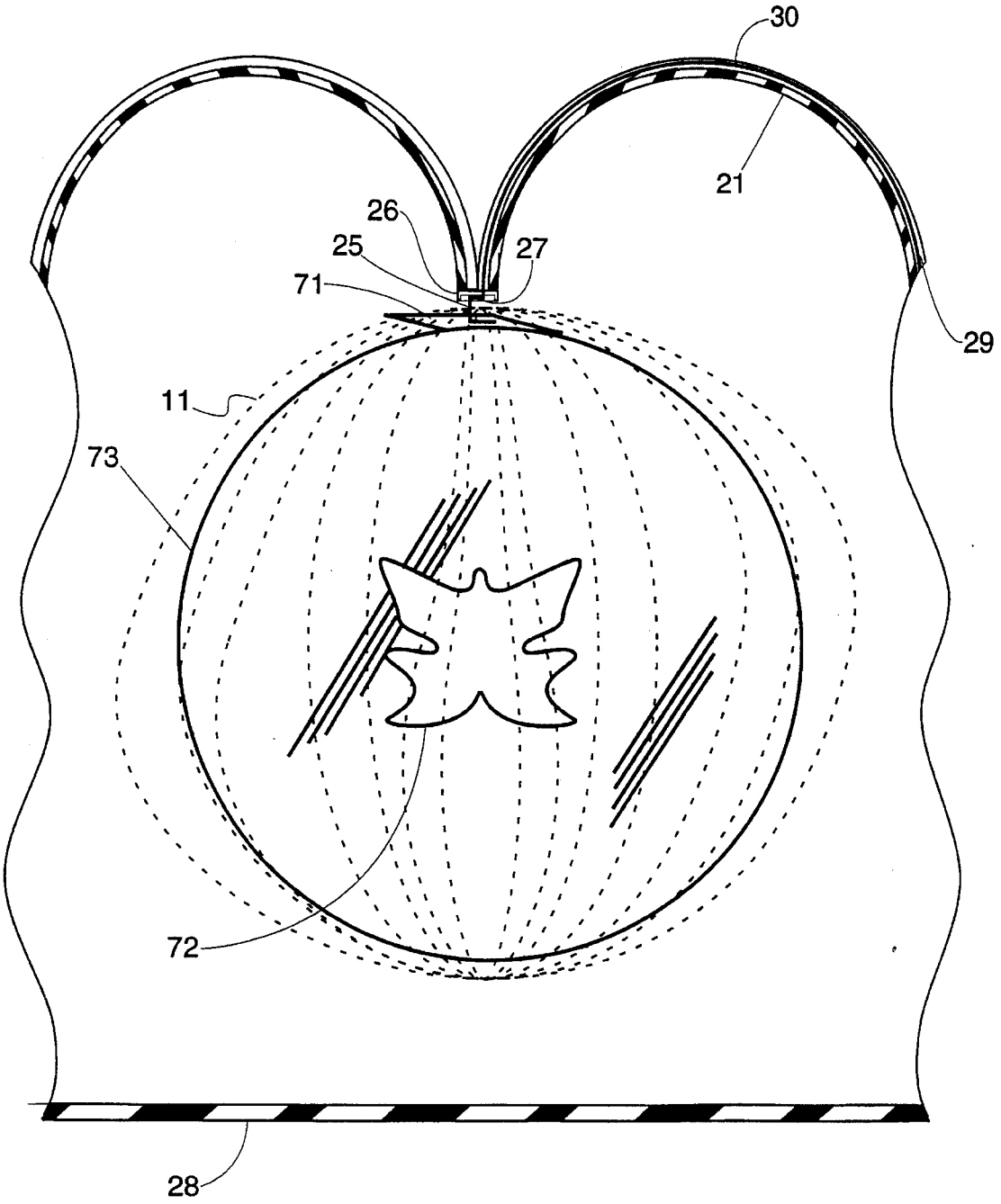
FIG. 4 is a close-up cutaway view of the acetate disk insert that allows objects to appear to be invisibly suspended within the MYLAR brand polyester film cage of the present invention.

Turning to FIG. 4, a further illusion effect may be accomplished by means of a clear acetate disk 73 which is inserted vertically inside the cage 12. A small clear tab 71 at the top of the acetate disk 73 attaches to joining MYLAR brand polyester film disk 24 underneath the top of cage 12, thus holding acetate disk 73 in place. In the exact center of acetate disk 73 a desired object is mounted. If the object is two dimensional, such as a picture, it is advantageous to use two of the same images mounted back to back on either side of acetate disk 73. If the object is three dimensional, a pattern such as hole 72 is cut out of the center of the disk to match the outline of the object so that the object, mounted within this hole, will be centered exactly below the top of cage 12. Because the bubble 11 is not in fact a solid surface, the viewer will also see the object on acetate disk 73 in the interstices between strands 13 as cage 12 rotates. Thereby, the object borne on the acetate disk will appear to "float" within bubble 11, with no visible means of support. The reflections produced off the surface of the spinning acetate disk 73 are easily masked by the many reflections of strands 13 of the revolving cage.

Figure 5:
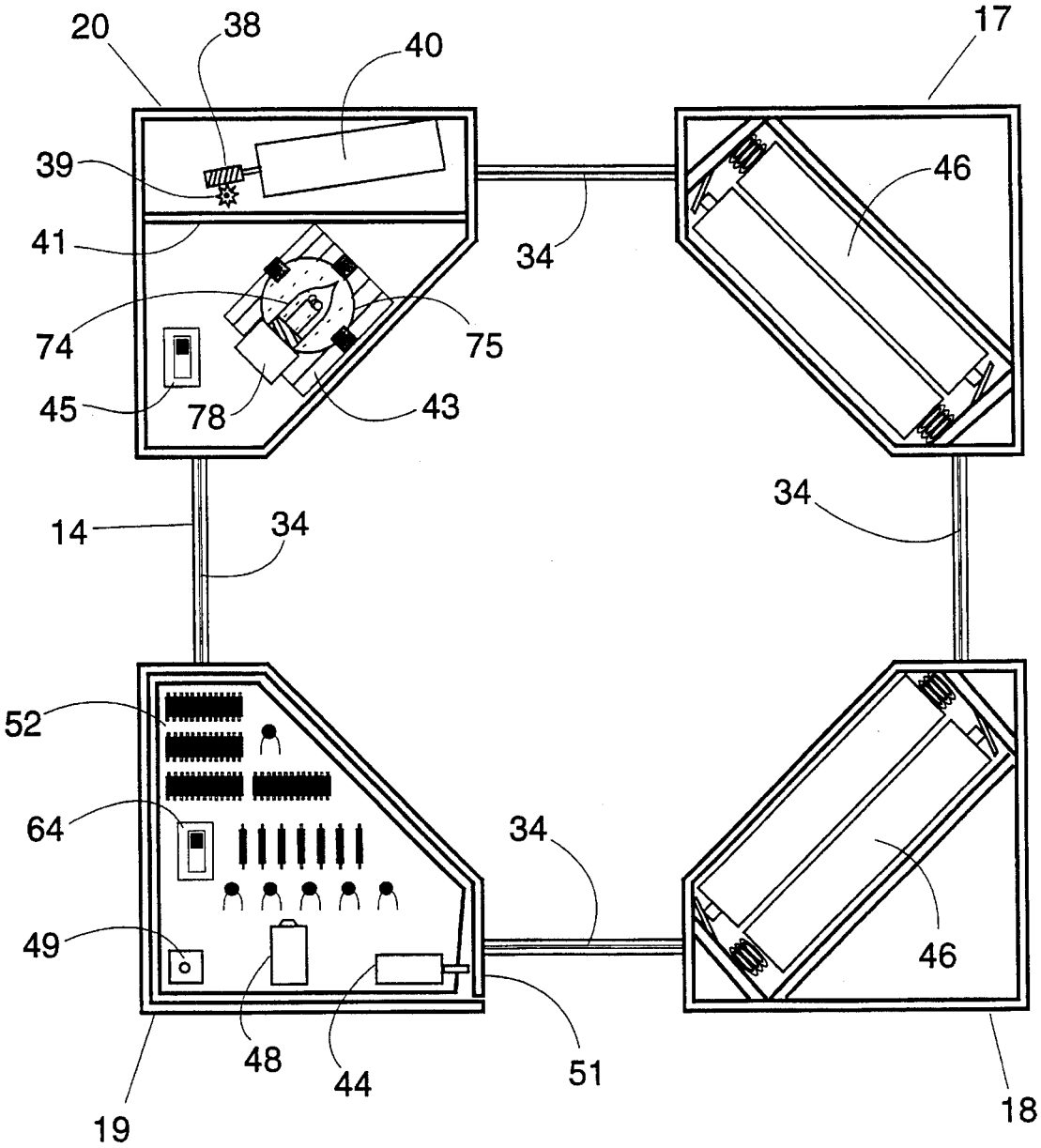
FIG. 5 is a bottom cutaway view of the four bases of the present invention showing the position of motor elements, light source, batteries, controlling electronic circuit and switches.

Turning now to FIG. 5, the arrangement of elements within each of the bases is illustrated. As noted earlier, motor 40 is completely encased in base 20 along with worm gear 38, sprocket wheel 39 and coupler 42. Motor 40 consists of a standard fractional horsepower DC motor of the type manufactured by Mabuchi Motor, operated in the 1.5–3.0 volt range to produce the desired 1200–1700 rpm output. Also encased in base 20 are bulb fixture 78, light bulb 74, and switch 45. While other bulbs may be used, light bulb 74 advantageously consists of a small 3 or 6 volt DC krypton or halogen bulb. A small transparent lens 75 mounted above the bulb under the top surface of base 20 acts as a focusing device to direct the light from bulb 74 through louvers 43 onto the spinning bubble 11, note again FIG. 1. Louvers 43 act both to direct the light from bulb 74 and to help shield it from the direct view of the observer. Switch 45 is provided to selectively engage light bulb 74. Switch 45 advantageously consists of a miniature single-pole-single-throw (SPST) slide type switch. Access to switch 45 is from underneath base 20 so that it is concealed from the observer during operation. A vertical interior dividing wall 41 inside base 20 conceals motor 40 from view at such times that the user needs to replace bulb 74 by removing a small plate (not shown) on the bottom of base 20. This self-contained illumination greatly augments the display of colors from the silver diffraction grating and is particularly effective when the invention is utilized in a darkened room.

Concealed within base 19 upon circuit board 52 is push-button switch 44 which is provided to selectively engage the illusion. Switch 44 is actuated by pressing in flexible side wall 51 of base 19. Concealing the switch in such a manner keeps even this simple operational element of the invention from view of the casual observer. As a safety feature to protect the invention, the illusion is additionally controlled through switch 49 which is also concealed in base 19 upon circuit board 52. Switch 49 advantageously consists of a sub-miniature momentary contact type switch wired in the normally open position with its actuating button or lever protruding through a hole in the bottom plate (not shown) of base 19. When the invention is resting on a firm, level surface, switch 49 is engaged into the closed position thereby allowing operation of the illusion. If the invention is lifted even slightly, switch 49 disengages into the open position and the illusion is either prevented from or halted in operation. Also concealed within base 19 upon circuit board 52 is switch 64 which selectively engages the various driving circuits of circuit 52 which will be detailed below.

Because of their small physical size and high current capacity, motor 40, light bulb 74 and circuit 52 are advantageously powered by four "AA" cell batteries 46 in a standard arrangement. In a preferred embodiment, batteries 46 are disposed in pairs and concealed in bases 17 and 18 and may be replaced by the user through removable plates (not shown) in the bottom of bases 17 and 18. However, different battery types and power configurations may also be used. For example, batteries 46 may be replaced with a system of interconnected solar cells mounted on the outside surfaces of one or more of the bases 17–20 and thus enable a completely solar powered unit. Still further, an AC adapter and wall outlet cord in a standard arrangement may be provided to permit use of available line electricity. Adapter plug 48 mounted on circuit board 52 and concealed within base 19 accommodates this option of supplying power to the invention. Access to plug 48 is made through a hole in the bottom plate (not shown) of base 19.

A small groove 34 along the bottom edge of each of the side walls of case 14 allows interconnecting wiring to run virtually invisibly between battery bases 17 and 18 and circuit and motor bases 19 and 20. Such wiring advantageously consists of 30 gauge enameled wire that can be paired in this single groove without the need for further insulation. An alternative embodiment (not shown) comprises an extension and connection of the narrow ends of the four bases 17–20 so that they effectively form a single square "ring" upon which case 14 rests. This would still leave the area directly beneath spinning cage 12 as open as it is with the use of individual bases, yet allow wiring to easily be concealed as it runs between the various internal elements of the invention.

Figure 6A:
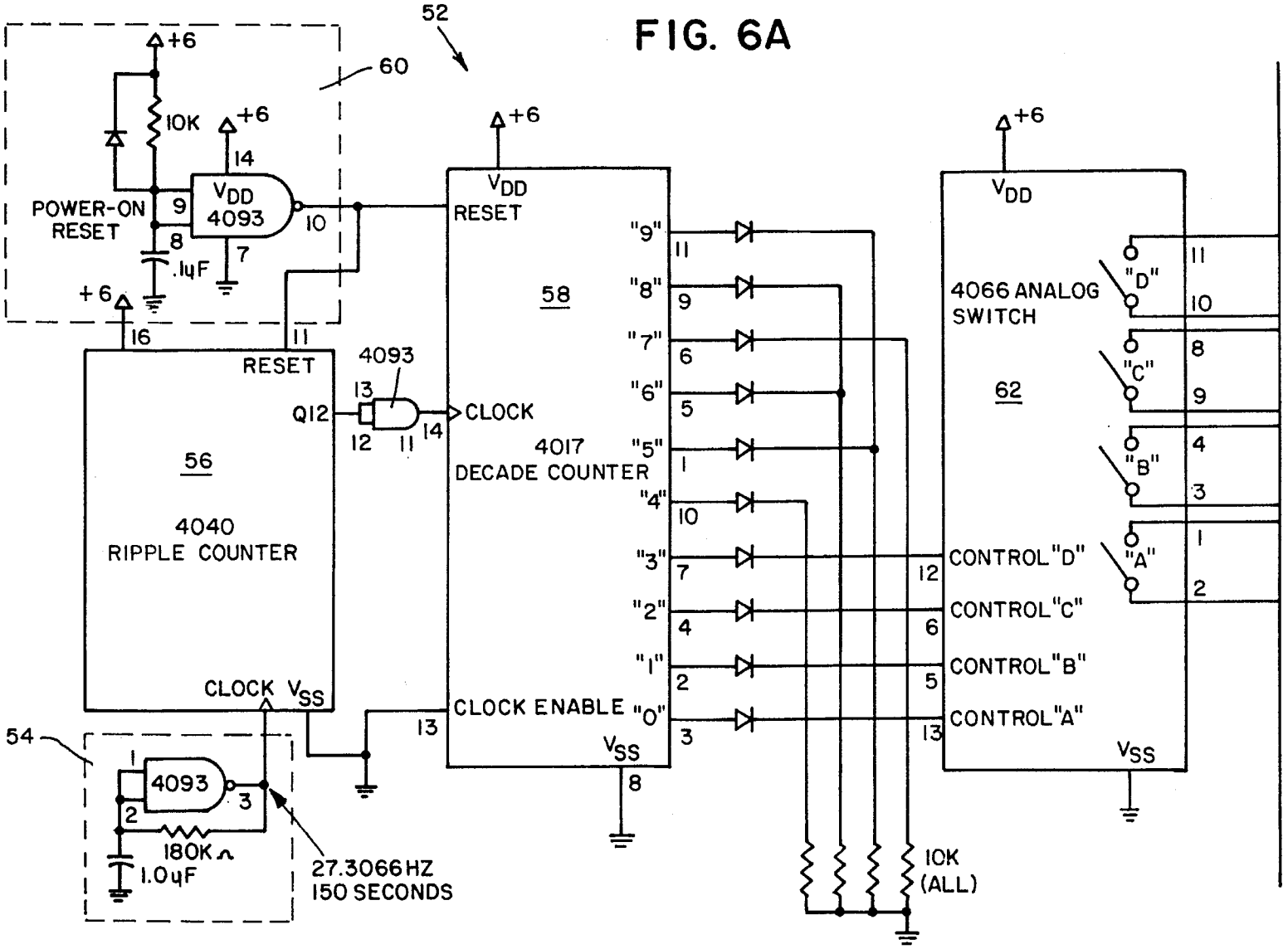
FIGS. 6A and 6B are collectively a schematic representation of the operational circuit of the present invention.
Figure 6B:
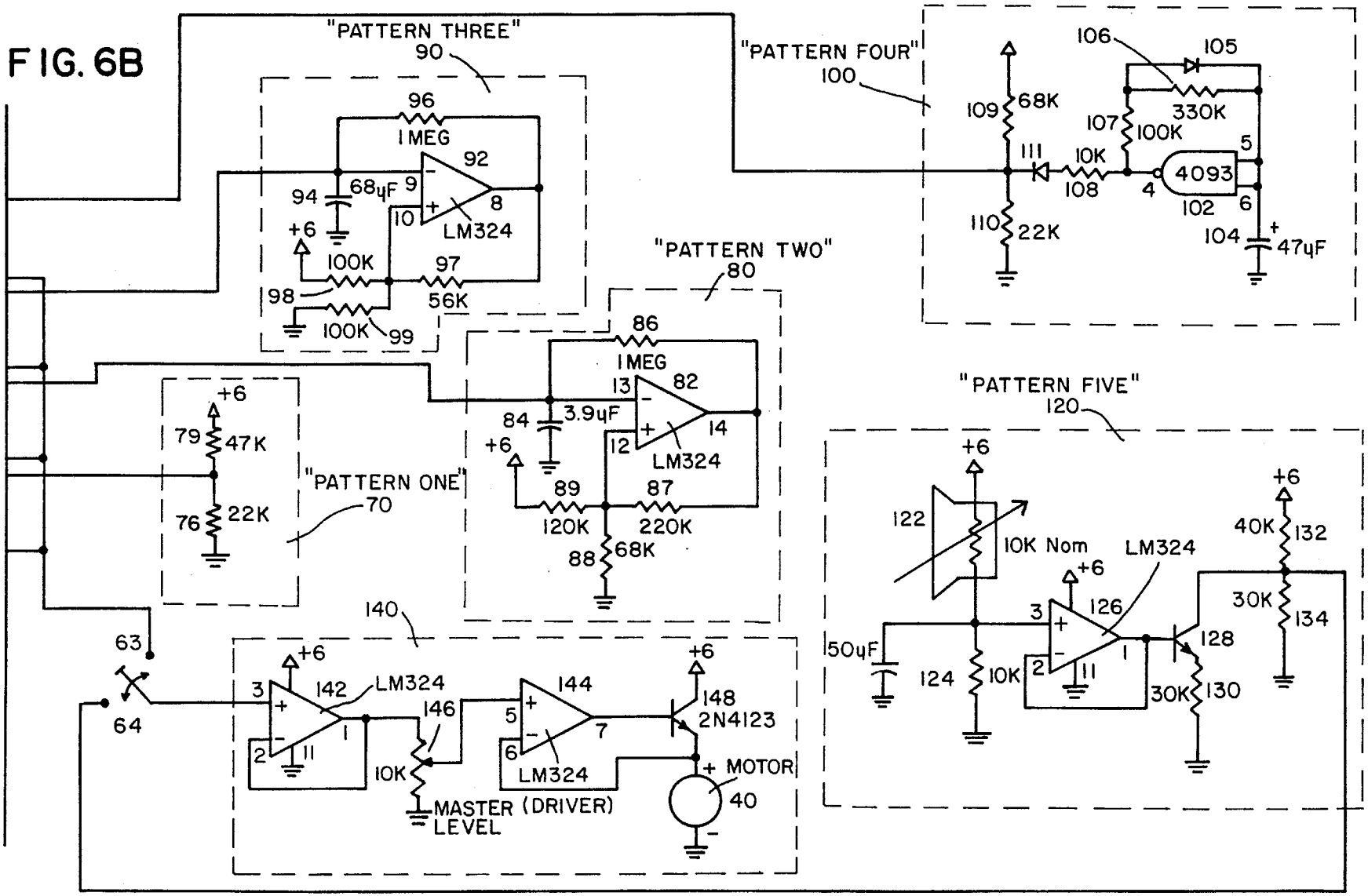

With reference to the schematic diagram of FIGS. 6A and 6B, the arrangement of the power circuit of the present invention may be seen. Circuit 52 is designed to control the speed of motor 40 in five distinct patterns. As noted earlier, changing the speed of motor 40 changes the speed of rotation of cage 12 and therefore changes the shape of bubble 11. Pattern 1 operates the motor at a constant speed of approximately 215 revolutions per minute causing bubble 11 to assume a single, generally round shape, distorted only by the random fluttering of strands 13. Pattern 2 employs a triangle wave that gradually varies the speed of the motor up and down between 200 and 230 rpm with a frequency of about two seconds. This changes the shape of bubble 11 from slightly longer and narrower than the round shape of Pattern 1 to slightly flatter and wider than the shape of Pattern 1 in a periodic manner, thus giving the bubble a slow, "breathing" type of undulation similar to when an actual soap bubble is first released from a wand. Pattern 3 employs a longer triangle wave that gradually varies the speed of the motor up and down between the extremes of 180 and 250 rpm with a frequency of one clock cycle or about 90 seconds. This slowly changes the shape of bubble 11 from very long and cylindrical to very flat and wide. Pattern 4 employs a square waveform that shifts the speed of motor 40 back and forth between 180 and 250 rpm. The waveform has a frequency of about 2 seconds, spending approximately 65% of its cycle at 250 rpm and 35% at 180 rpm. This pattern causes bubble 11 to bounce up and down. Pattern 5 involves a sound sensitive circuit which permits the bubble to react to sound such as speech, music, clapping or other audible signals. The movement of bubble 11 will thereby follow the audible input of the user and can be made to move on command, or seemingly dance in time to music.

With specific reference to FIGS. 6A and 6B, circuit 52 of the present invention may be seen in detail. Circuit 52 begins with a clock pulse generator 54 and consisting of an RC biased hand gate. The output of clock pulse generator 54 is fed to the clock input of ripple counter 56. Ripple counter 56 in turn drives the clock input of decade counter 58. To ensure against terminal state faults at power off and on, a reset circuit 60 is provided to restart the system with each power on cycle. Five distinct driving circuits 70, 80, 90, 100, and 120 are available in the present invention, each chosen according to the desired output of the illusion. Decade counter 58 includes the capability of stepping between four of the driving circuits. As decade counter 58 cycles through its complete period, each of driving circuits 70, 80, 90, and 100 are periodically activated. Selected outputs of decade counter 58 are fed into the control inputs for analog switch 62. Analog switch 62 selectively closes switches A–D corresponding to driving circuits 70, 80, 90 and 100. Circuit 120, the fifth driving circuit, is selectively engaged by closing switch 64.

Driving circuit 70 corresponds to Pattern 1 noted above and causes the illusion of the present invention to remain in a relatively stable, steady state mode in which the illusion rotates at a nearly constant speed. Circuit 70 consists of 47K resister 79 in series with 22K resistor 76. The output of circuit 70 is fed into motor power circuit 140 over common bus 63.

Driving circuit 80 corresponds to Pattern 2 noted above and causes the illusion of the present invention to vary continuously in speed producing an undulating "breathing" type distortion of the bubble. Circuit 80 consists of amplifier 82 provided with both inverting and non-inverting feedback. The arrangement and element values shown in detail in FIG. 6 produces alternate charging and discharging of capacitor 84 through resistors 86–89. Again the output of circuit 80 is fed to motor power circuit 140 through common bus 63.

Driving circuit 90 corresponds to Pattern 3 noted above and causes the illusion of the present invention to cyclically vary continuously from the highest and lowest recommended speed for the device producing an elongation and flattening type distortion of bubble 11. Circuit 90 consists of amplifier 92 again provided with both inverting and non-inverting feedback. The arrangement shown in detail in FIG. 6 produces alternate charging and discharging of capacitor 94 through resistors 96–99. Because of the lower value of resistors 97–99 and the higher value of capacitor 94 compared to driving circuit 80, the period of the variation of circuit 90 will be longer and the amplitude greater, thus producing the extreme elongation and flattening. Again the output of circuit 90 is fed to motor power circuit 140 through common bus 63.

Driving circuit 100 corresponds to Pattern 4 noted above and causes the illusion of the present invention to change its speed according to a step function, producing bouncing like movements in bubble 11. Circuit 100 consists of a nand gate 102 provided with capacitor 104 as a charge/discharge driving input. Capacitor 104 charges through resistor 107 and diode 105. When the voltage across capacitor 104 reaches the "high" input voltage of nand 102, the output of nand 102 falls to zero. Capacitor 104 then discharges through resistors 106, 107, and 108 in series. Diode 105 prevents bypass of resistor 106 on the discharge cycle. When the voltage across capacitor 104 falls below the "low" input voltage of nand 102, the output of nand 102 returns to high and the cycle begins again. Again the output of circuit 100 is fed to motor power circuit 140 through common bus 63.

The above patterns 1 through 4 above are distributed over the ten clock cycles 0 through 9 of decade counter 58 in the following order: Pattern 1 is in operation during clock cycles zero and four; Pattern 2 is in operation during clock cycles one, six and eight; Pattern 3 is in operation during clock cycles two, five and nine; and Pattern 4 is in operation during clock cycles three and seven. The circuit is advantageously designed so that each pattern, with the exception of Pattern 1, begins at a random point in its waveform as its cycle is initiated. This factor, combined with the particular distribution of the movement patterns assigned to each clock count, is intended to introduce a random, unpredictable element to the movement of the bubble.

Driving circuit 120 causes the illusion of the present invention to respond to audible inputs such as music, speech or clapping. Circuit 120 consists of a microphone 122 provided with a resistor/capacitor bias network 124 as shown. Microphone 122 is provided with variable resistance to ensure that the circuit is biased toward the middle of the operating characteristic of motor 40 to provide for full variability. The output of microphone 122 is fed into the non-inverting terminal of amplifier 126. The inverting terminal of amplifier 126 is provided with direct feedback from the output of amplifier 126. The output of amplifier 126 is directed to the base of transistor 128. The output of transistor 128 is then directed to motor power circuit 140 through resistors 130, 132 and 134. Thus the movement of bubble 11 may be changed in a non-periodic manner.

Figure 6D:
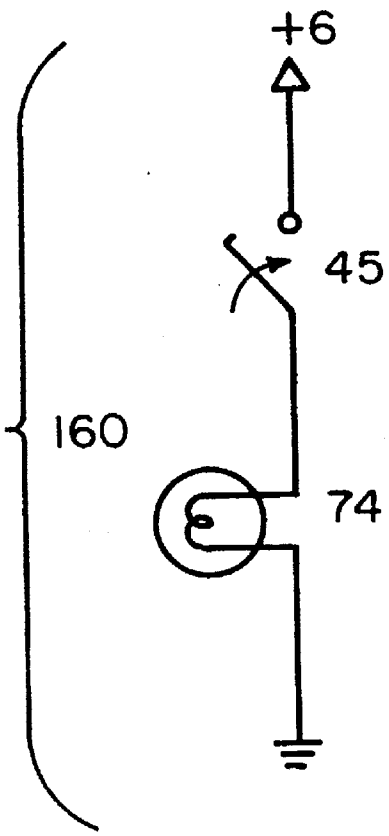
FIG. 6D is a schematic representation of the illumination element circuit of the present invention.
Figure 6C:
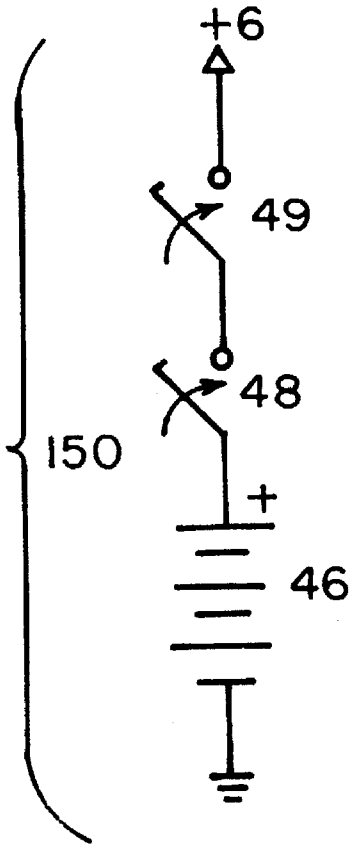
FIG. 6C is a schematic representation of the basic power circuit of the present invention.

Motor power circuit 140 consists of amplifiers 142 and 144 connected through variable resistor 146. Variable resistor 146 may be used to tune motor power circuit 140 to the center of the operating characteristic of motor 40. The output of amplifier 144 is used to drive power transistor 146 which feeds current directly to motor 40. Master supply circuit 150 is shown in FIG. 6C and consists of the two switches 48 and 49 in series with battery assembly 46. The light circuit 160 which provides illumination of spinning cage 12 is shown in FIG. 6D and consists of bulb 74 in series with switch 45.

In summary, it has been disclosed herein a novelty illusion device comprising a transparent case, an illusion object disposed within the case, a motor for providing rotational force, a circuit for selectively controlling the operation of the motor, power means for providing electric current to the motor, drive shaft means for transmitting the rotational force from the motor to the illusion object, and means to render the drive shaft means virtually invisible to an observer when the drive shaft is transmitting rotational force from the motor to the mylar illusion object. The novelty illusion device is also characterized in that the case comprises several sides joined at elongated corners and the drive shaft is disposed adjacent one of the corners to conceal it from view by an observer. The novelty illusion device is further characterized in that the drive shaft means comprises an elongated section of steel wire. The novelty illusion device also includes a variable voltage circuit for providing different levels of power to the motor, a non-transparent base for supporting the transparent case, and means for concealing the motor and the control circuit within the non-transparent base. The novelty illusion device is also characterized in that the illusion object comprises a plurality of strips of mylar material joined at common distal and proximal ends to form a cage structure. The novelty illusion device also includes an acetate disk disposed within the cage structure bearing an object or image.

It has also been disclosed herein a method for producing a novelty illusion comprising the steps of providing a transparent case, placing an illusion object within the case, supporting the illusion object with a drive shaft, imparting rotational energy to the drive shaft to thereby rotate the illusion object, selectively controlling the rotational velocity of the drive shaft, and concealing the drive shaft to render the drive shaft virtually invisible to an observer when the drive shaft is transmitting rotational force to the illusion object. The novelty illusion method also comprises the step of constructing the illusion object by joining a plurality of strips of MYLAR brand polyester film material at common distal and proximal ends to form a cage structure. The novelty illusion method further includes the step for concealing the drive shaft which includes forming a groove adapted to receive the drive shaft in the transparent case and inserting the drive shaft into the groove. The novelty illusion method also includes the step for selectively controlling the rotational velocity of the drive shaft which includes providing a direct current motor responsive to a direct current power signal to provide the rotational energy and providing a variable voltage control circuit for varying the input voltage to the motor.

It has also been disclosed herein a novelty illusion device comprising a transparent case, an illusion object disposed within the case, an electric motor for producing rotational force, power circuit means operatively disposed between the power source and the motor for altering the current present to the motor to selectively control the operation of the motor, drive shaft means for transmitting the rotational force from the motor to the illusion object, and means to render the drive shaft means virtually invisible to an observer when the drive shaft is transmitting rotational force from the motor to the illusion object. The novelty illusion device is also characterized in that the transparent case comprises a groove adapted to receive the drive shaft and the drive shaft is disposed within the groove to conceal it from view by an observer. The novelty illusion device is further characterized in that the drive shaft means comprises an elongated section of steel wire. The novelty illusion device is also characterized in that the illusion object comprises a plurality of strips of MYLAR brand polyester film material joined at common distal and proximal ends to form a cage structure. The novelty illusion device is further characterized in that the power circuit means for altering the current presented to the motor comprises a periodic circuit means for varying the amplitude of the current in a repetitious manner and amplifier means operatively disposed between the periodic circuit means and the motor for amplifying the current presented to the motor. The novelty illusion device is also characterized in that the power circuit means for altering the current presented to the motor comprises non-periodic circuit means for varying the amplitude of the current in a non-repetitious manner and amplifier means operatively disposed between the non-periodic circuit means and the motor for amplifying the current presented to the motor. The novelty illusion device is further characterized in that the non-periodic circuit means for varying the amplitude of said current in a non-repetitious manner comprises microphone means for detecting audible signals and sound control circuit means responsive to said microphone means for varying the amplitude of said current in response to audible signals occurring proximate to said device.

It should be appreciated that there has been disclosed in accordance with the present invention, the preferred embodiment of an improved novelty illusion device. It is evident that many alternatives, common modifications, and variations would be apparent to one of ordinary skill in the art in light of the description set forth herein. Accordingly, the present invention is intended to embrace all such alternatives, modifications, and variations that fall within the spirit and broad scope of the following appended claims.

I claim:

1. A novelty illusion device comprising:

a transparent case;

an illusion object disposed within said case;

a motor for producing rotational force;

a circuit for selectively controlling the operation of said motor;

power means for providing electric current to said motor;

drive shaft means for transmitting said rotational force from said motor to said illusion object; and means to render said drive shaft means virtually invisible to an observer when said drive shaft is transmitting rotational force from said motor to said illusion object.

2. The novelty illusion device of claim 1 wherein:

said case comprises several sides joined at elongated corners;

and said drive shaft is disposed adjacent one of said corners to conceal it from view by an observer.

3. The novelty illusion device of claim 2 wherein said drive shaft means comprises an elongated section of steel wire.

4. The novelty illusion device of claim 1 further comprising:

a variable voltage circuit for providing different levels of power to said motor.

5. The novelty illusion device of claim 1 further comprising:

a non-transparent base for supporting said transparent case; and means for concealing said motor and said control circuit within said non-transparent base.

6. The novelty illusion device of claim 1 wherein:

said illusion object comprises a plurality of strips of MYLAR brand polyester film material joined at common distal and proximal ends to form a cage structure.

7. The novelty illusion device of claim 6 further comprising:

an acetate disk disposed within said cage structure bearing an object or image.

8. A method for producing a novelty illusion comprising the steps of:

providing a transparent case;

placing an illusion object within said case;

supporting said illusion object with a drive shaft;

imparting rotational energy to said drive shaft to thereby rotate said illusion object;

selectively controlling the rotational velocity of said drive shaft; and concealing said drive shaft to render said drive shaft virtually invisible to an observer when said drive shaft is transmitting rotational force to said illusion object.

9. The novelty illusion method of claim 8 further comprising the step of constructing said illusion object by joining a plurality of strips of MYLAR brand polyester film material at common distal and proximal ends to form a cage structure.

10. The novelty illusion method of claim 8 wherein said step for concealing said drive shaft includes:

forming a groove adapted to receive said drive shaft in said transparent case; and inserting said drive shaft into said groove.

11. The novelty illusion method of claim 8 wherein said step for selectively controlling the rotational velocity of said drive shaft includes:

providing a direct current motor responsive to a direct current power signal to provide said rotational energy; and providing a variable voltage control circuit for varying the input voltage to said motor.

12. A novelty illusion device comprising:

a transparent case;

an illusion object disposed within said case;

an electric motor for providing rotational force;

a power source for providing electric current to said motor;

power circuit means operatively disposed between said power source and said motor for altering the current presented to said motor to selectively control the operation of said motor;

drive shaft means for transmitting said rotational force from said motor to said illusion object; and means to render said drive shaft means virtually invisible to an observer when said drive shaft is transmitting rotational force from said motor to said illusion object.

13. The novelty illusion device of claim 12 wherein:

said transparent case includes a groove adapted to receive said drive shaft; and said drive shaft is disposed within said drive shaft to conceal it from view by an observer.

14. The novelty illusion device of claim 13 wherein said drive shaft means comprises an elongated section of steel wire.

15. The novelty illusion device of claim 12 wherein:

said illusion object comprises a plurality of strips of MYLAR brand polyester film material joined at common distal and proximal ends to form a cage structure.

16. The novelty illusion device of claim 12 wherein said power circuit means for altering the current presented to said motor comprises:

periodic circuit means for varying the amplitude of said current in a repetitious manner;

amplifier means operatively disposed between said periodic circuit means and said motor for amplifying said current presented to said motor.

17. The novelty illusion device of claim 12 wherein said power circuit means for altering the current presented to said motor comprises:

non-periodic circuit means for varying the amplitude of said current in a non-repetitious manner;

amplifier means operatively disposed between said non-periodic circuit means and said motor for amplifying said current presented to said motor.

18. The novelty illusion device of claim 17 wherein said non-periodic circuit means for varying the amplitude of said current in a non-repetitious manner comprises:

microphone means for detecting audible signals;

sound controlled circuit means responsive to said microphone means for varying the amplitude of said current in response to audible signals occurring proximate to said device.

* * * * *